United States Patent [19]

Giese et al.

[11] 4,281,468

[45] Aug. 4, 1981

[54] SKI BOOT HAVING A CORRUGATED FRONT PORTION

[75] Inventors: Erik O. Giese, Key Biscayne, Fla.; Dixie L. Rinehart; Alexander L. Gross, both of Aspen, Colo.

[73] Assignee: Comfort Products, Inc., Aspen, Colo.

[21] Appl. No.: 67,178

[22] Filed: Aug. 16, 1979

[51] Int. Cl.[3] ..... A43B 5/04; A43B 11/00

[52] U.S. Cl. ..... 36/121; 36/50

[58] Field of Search ..... 36/105, 117, 120, 121, 36/50

[56] References Cited

U.S. PATENT DOCUMENTS

| | | | |
|---|---|---|---|
| 4,043,059 | 8/1977 | Rathmell | 36/121 |
| 4,073,073 | 2/1978 | Seidel | 36/105 |
| 4,085,528 | 4/1978 | Delery | 36/121 |
| 4,095,356 | 6/1978 | Robran et al. | 36/105 |

FOREIGN PATENT DOCUMENTS

| | | | |
|---|---|---|---|
| 2730550 | 1/1979 | Fed. Rep. of Germany | 36/121 |

*Primary Examiner*—Patrick D. Lawson

*Attorney, Agent, or Firm*—Pennie & Edmonds

[57] ABSTRACT

A ski boot having a stiff outer shell and a soft inner boot within the shell. A front part of the ski boot has a stiff corrugated front portion adapted to overlap the top and forward portion of the lower leg of the wearer and which allows the wearer to bend the lower leg in the forward direction to flex the corrugated front portion while allowing the heel of the wearer to remain in the heel portion of the shell.

9 Claims, 6 Drawing Figures

SKI BOOT HAVING A CORRUGATED FRONT PORTION

TECHNICAL FIELD

The invention relates to a ski boot having a stiff shell portion and a stiff corrugated front portion which allows the wearer of the boot to bend forward while keeping the heel in the heel portion of the shell.

BACKGROUND ART

Ski boots made to date usually comprise stiff outer plastic shells enclosing relatively soft inner boots. The stiff outer shell of a boot functions to provide support and stability to the ankle and lower leg of the wearer under varying conditions as may occur during straightaway, turning and jumping maneuvers. The outer shell of such a prior art boot extends above the ankle of the wearer to provide the necessary strength and support for the lower leg, and, because of its stiffness, makes turning of the ankle difficult since the boot does not usually flex along lines corresponding to the natural movement of the ankle.

It is desirable in many ski maneuvers that the weight of the skier be directed towards the forward part of the skis to provide a direct transmission of force from the legs to the skis. This requires that the skier bend his knees in the forward direction such that for a particular leg the thigh extends generally parallel with a line corresponding to the direction of force to be applied to a ski. Such bending is difficult and uncomfortable with prior art boots because the stiff forward part of the shell prevents sufficient or natural forward movement of the rear of the shell or of any cuff that may be attached to the rear of the shell. The result is that as the leg is bent forward, a gap is formed between the back of the leg and the rear of the inner boot and/or the outer shell thus reducing snug fitting of the boot with the lower leg in turn reducing the support and stability functions of the boot. This loss of a snug fit also allows the heel of the wearer to raise with respect to the heel portion of the shell thus further aggravating diminution of stability and support properties of the boot.

Further a conventionally constructed boot having a stiff shell which completely surrounds the foot and lower leg of a wearer provides little shock-absorbing qualities such that shocks imparted to a ski are transmitted much more directly to the leg.

Conventionally constructed boots having a stiff forward portion overlying the top of the foot tend to bulge or bow outwardly in the area of the boot near where the forefoot area of the sole joins the sides of the shell during forward flexing. This bowing reduces snug engagement of the foot by the inner boot and shell such that the foot may, in some instances, be able to move with respect to the shell causing a still further lessening of control of the ski.

It is therefore an object of our invention to provide for a ski boot construction which will allow a skier to easily bend his knees forward such that forces may be progressively and evenly applied to the forward part of the skis and where the flex lines of the boot correspond to the natural flex lines of an ankle.

It is a further object to provide for a boot construction that will maintain a snug fit between the back of a lower leg and the rear portion of a boot as the leg is bent forward to assure that the heel of the wearer remains in the heel portion of the shell and to provide lateral support to the foot throughout the full range of forward and backward movement of the leg.

It is also an object of the invention to provide for a boot construction which will eliminate significant bow or bulge effect occurring near the foresole area of the boot and boot sides as a leg is bent forward.

It is still a further object of the invention to provide for a boot construction which is shock-absorbing in the upward, rear, forward and side directions and which will provide a spring-back effect tending to return the foot to the normal position with respect to a ski when bending forces are removed.

DISCLOSURE OF INVENTION

Generally a ski boot constructed according to the invention comprises a relatively stiff outer shell including a heel portion and where the boot has a stiff corrugated front portion adapted to overlap the top of the foot and the front part of the lower leg of the wearer. A soft inner boot is positioned in the shell and is adapted to engage the foot of the wearer. The corrugated front portion allows the skier to bend his knees forward thus flexing the corrugated portions. The flexing of the stiff corrugated front portion provides a degree of spring-back tending to return the foot and leg to the normal unbent position when bending forces are removed. The corrugated front portion primarily controls the flex characteristics of the boot. The hills and valleys forming the corrugations individually flex to provide natural flexing of the front of the boot with a resistance that increases evenly as the skier bends forward which is important to sking function and comfort.

In one form of the invention the shell portion has cutouts in the rear and front portions with the corrugated front portion comprising a tongue overlapping the cutout of the front portion. A cuff is hinged at its lower end to the sides of the shell and overlaps the cutout of the rear portion such that when the leg is bent forward, the cuff will tend to press the sides of the rear cutout towards each other to firmly grasp the back of the inner boot and to eliminate any gap forming between the back of the leg of the skier and inner boot or between the inner boot and shell.

In a further embodiment of the invention the stiff corrugated front portion of the boot is integral with and forms a part of the stiff shell. The shell itself is made up of two parts comprising a front element and a back element with the back element being hinged near its bottom to the sides of the front element so that it may be pivoted outwardly of the boot in order that the foot of the wearer may be inserted into the boot. The back element may also be corrugated to allow bending of the leg both in a forward and a rearward direction to further impart control to a ski.

In both embodiments of the invention, fastening systems may be utilized which include cables adapted to be positioned in the valleys of the corrugations to fasten the cuff and tongue securely with respect to the shell or to fasten the two shell elements together. Sleeves of various sizes may be inserted over the cables to vary the effective thickness of the cables and to limit the movement of the hills of the corrugations towards each other upon bending and to thus provide a control of bending of the corrugated portions of the boot.

Slide means may be provided in the embodiment of the boot having the rear cutout in the shell to limit movement of the sides of the cutout toward each other and to control forward flex resistance.

BEST MODES FOR CARRYING OUT THE INVENTION

Figure 1:
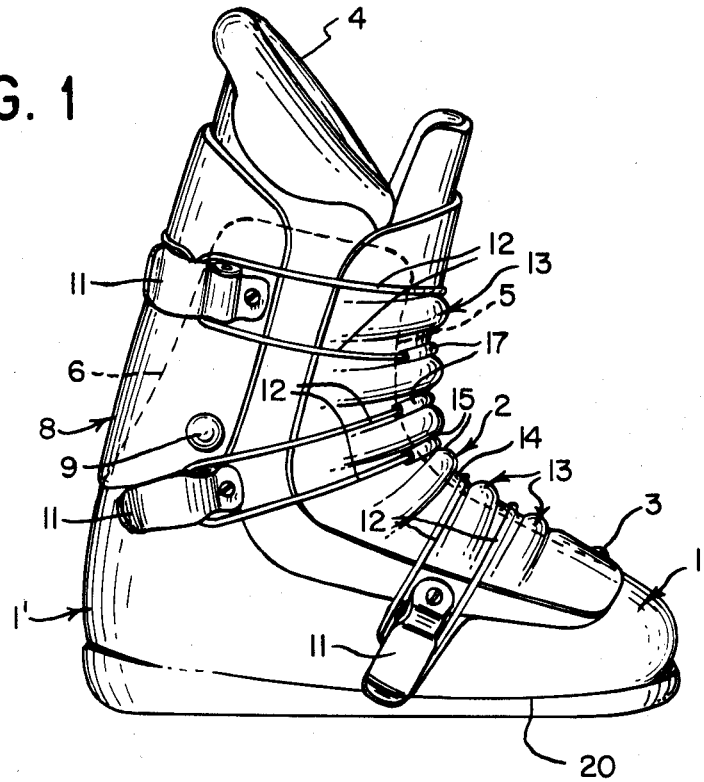
FIG. 1 is a side view of a boot constructed according to the invention having a corrugated tongue and a cuff.
Figure 2:
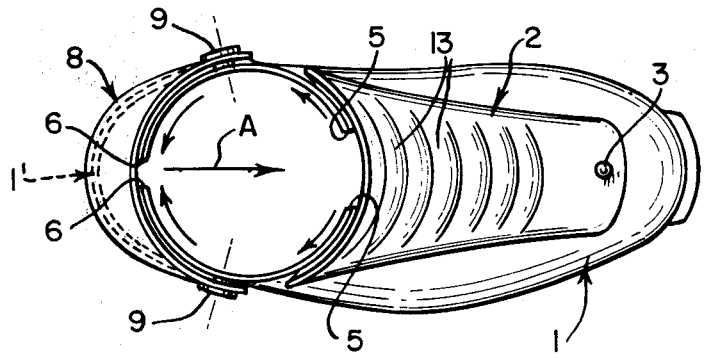
FIG. 2 is a plan view of the shell, tongue and cuff portions of the boot of FIG. 1.

Referring to FIG. 2 there is illustrated a ski boot constructed according to the invention having a stiff outer plastic shell 1 having a heel portion. A corrugated front portion 2 in the form of a tongue is attached to the shell by way of a rivet 3. The shell encloses a soft inner boot 4 adapted to engage the foot of a wearer. As shown in FIG. 1, the shell 1 has a cutout in the front part forming upstanding sides 5 and a cutout in the back part forming upstanding sides 6. The corrugated tongue overlaps the cutout on the front part of the shell while a movable cuff 8 overlaps the cutout on the back part of the shell. Cuff 8 is pivotally mounted on the sides of the shell by rivets 9 so that the cuff may move in a clockwise direction as shown in FIG. 1 when the leg of the wearer is bent forward.

A fastening system in the form of conventional buckles 11 and cables 12 serves to fasten the cuff 8 and tongue 2 securely with respect to the shell 1 such that the inner boot 4 will firmly grasp the foot of the wearer in the lower leg region and around the ankle.

The tongue 2 is preferably made from the same or similar stiff plastic as is the shell and the corrugations 13 provide a means by which the tongue may be flexed in the forward direction. The corrugations themselves comprise a series of valleys 14 interspersed with a series of hills 15 with the cables of the fastening system being positioned in the valleys 14.

The degree of flexure may be controlled by having interchangeable tongues of varying degrees of stiffness or varying corrugation configurations. For example the corrugations may be such that the hills are rounded with the valleys taking a more flat shape as shown in FIG. 1 or the hills could have a different shape thus changing flex characteristics.

The degree of flexure of the tongue in the forward direction may also be easily regulated by including sleeves 17 of various sizes on the cables 12 such that when the tongue is flexed forwardly, the sleeves 17 will engage the hills 15 of the corrugations to prevent further forward movement.

As shown in FIG. 2, as the wearer bends forward, the cuff 8 will move in the direction of the arrow A towards the front of the boot to press the edges 6 of the cutout of the rear portion towards each other. This assures that the back of the shell will continue to fit tightly with the back of the inner boot (not shown in FIG. 2) so as to maintain a snug engagement between the back of the lower leg and inner boot and rear of the shell. Further the cutout in the front portion of the shell allows the edges 5 to move towards and away from one another to prevent bowing or bulging of the sides of the shell near the forefoot area 20 of the sole of the shell thus providing added support to the foot.

While a buckle-cable fastening system is disclosed, it is obvious that other fastening systems can be utilized, the requirement being that the tongue and the cuff be fastened securely with respect to the shell in order that the inner boot will snugly engage the foot of the wearer in all positions. Further while the cuff is shown being riveted to the shell so as to pivot about the rivets 9, it is also apparent that the cuff could be attached to the shell by other means, the only requirement being that the cuff be able to pivot about its lower portion with respect to the shell.

Figure 3:
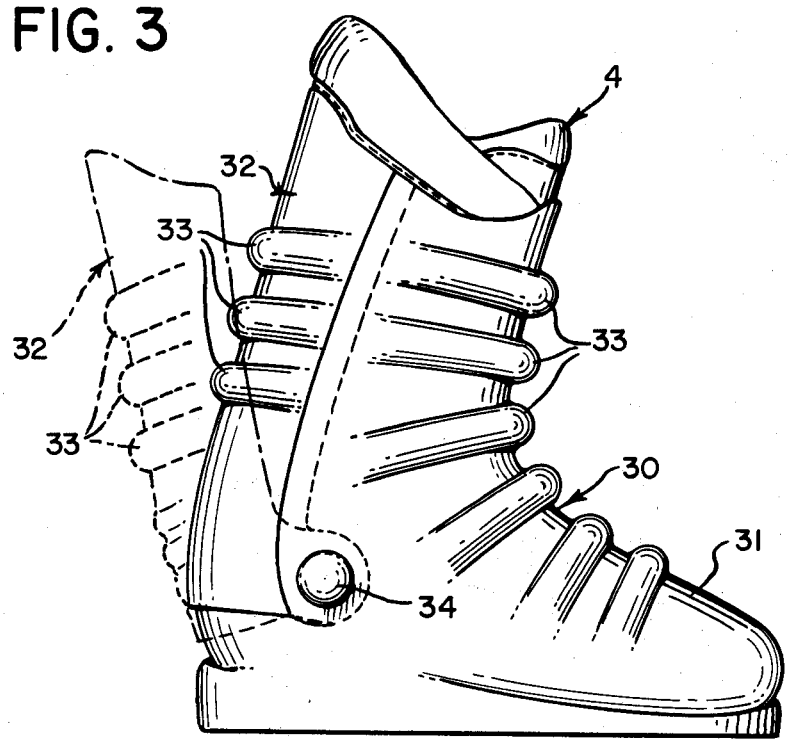
FIG. 3 is a side view of a further embodiment of a boot constructed according to the invention where the shell comprises front and rear elements.

Referring to FIG. 3 a further embodiment of a ski boot constructed according to the invention is illustrated in which the boot comprises a shell 30 having a front element 31 and a back element 32. The shell 30 is made from a stiff plastic material and includes a corrugated front portion 33 which is integral with the front shell element 31. An inner boot 4 similar to the inner boot 4 embodiment of FIG. 1 is included within the front shell element 31.

The back shell element 32 may be corrugated as shown and is mounted to pivot about rivets 34 such that the element may be rotated to the dotted position in order that the foot of the wearer may be slipped into the inner boot. The boot of FIG. 3 has a fastening system similar to that shown in FIG. 1 comprising a buckle-cable arrangement but for clarity is not illustrated.

Figure 4:
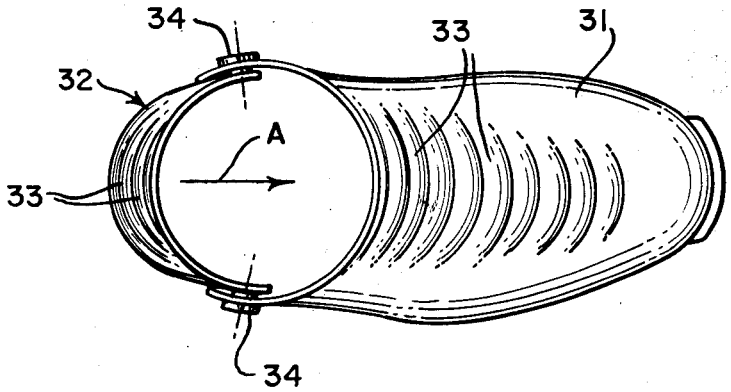
FIG. 4 is a plan view of the shell of the boot of FIG. 3.

As shown in FIG. 4, when the leg of the wearer bends forward, the rear element 32 may also move forward so as to continue to firmly grasp the inner boot and rear of the leg of the wearer and to prevent any bowing or bulging of the elements making up the shell. The corrugations of the front element 30 provide similar degrees of flexibility as provided by the tongue of the embodiment of FIG. 1. The corrugations 31 on the rear element provide additional flexibility in those cases where for maneuvering purposes weight is to be directed towards the rear of the skis. Corrugations 31 also assist in the natural forward flexing of the boot.

The boot constructions of both FIGS. 1 and 3 permit flexing in the forward direction while providing support at the sides since the sides of the boot are not corrugated at the sides. This particular construction allows greater ease in directing control forces to a ski particularly in turns where the leg may be easily bent forward in a slightly inward manner to assure that the outside edges of the skis will dig in to assist in turns. The constructions of both boots in turn provide greater comfort in that they allow the relatively stiff portions of the shell to move in directions corresponding to the natural movement of the ankle. At the same time the corrugations provide a spring effect to help absorb shocks and to return the leg to an unbent condition when desired.

Figure 5:
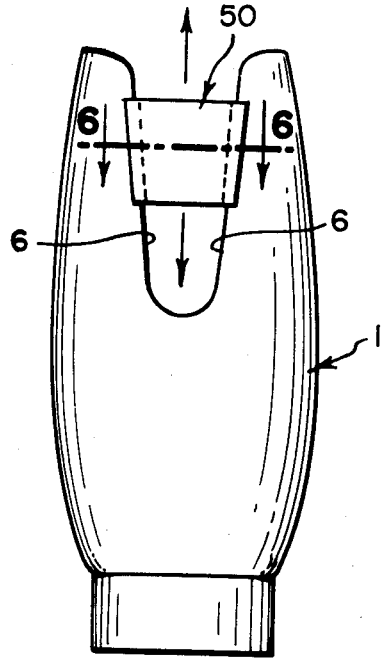
FIG. 5 is a rear end view of a further embodiment of a boot constructed according to the invention having a shell similar to that of the boot of FIG. 1.
Figure 6:
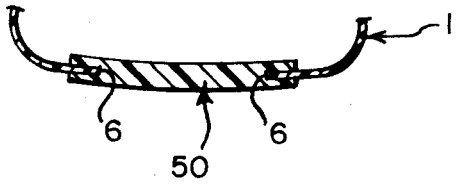
FIG. 6 is an enlarged sectional view of FIG. 5 taken along lines 6—6.

Referring to FIG. 5 there is illustrated a further embodiment of the boot of FIG. 1 which includes a vertically adjustable slide 50 which slides along the edges 6 of the cutout of the rear portion of the shell 1. Thus movement of the slide 50 in an upward or downward direction varies the amount that the edges 6 may move with respect to each other such that the upper portion of the boot may be varied to an extent to accommodate legs of varying sizes to insure firm engagement of the upper part of the boot with a leg. Movement of the slide 50 also adjusts forward flex resistance of the boot. Thus movement of the slide in an upward direction increases forward flex resistance while downward movement decreases flex resistance.

We claim:

1. A ski boot comprising a stiff outer shell having sides adapted to extend above the ankle of the wearer and having a heel portion adapted to overlap the heel of the wearer, a stiff corrugated front portion adapted to overlap the top of the foot and forward portion of the lower leg of the wearer and adapted to transmit control forces from the leg of the wearer to a ski, and a soft inner boot within said shell adapted to engage the foot and lower leg of the wearer whereby the wearer may bend the lower leg forward to flex said corrugated front portion while maintaining the heel in the heel portion of the shell.

2. A ski boot according to claim 1 wherein the front and back portions of the shell are cut away to allow forward and rearward bending movement of the inner boot and leg with respect to the shell.

3. A boot according to claim 2 wherein said corrugated front portion comprises a tongue overlapping the cut away of the front portion of the shell and having in addition a stiff hinged cuff overlapping the cut away of the rear portion of the shell.

4. A ski boot according to claim 3 whereby said cuff is pivoted at its bottom to the sides of said shell whereby when the leg of the wearer is bent in a forward direction, the cuff will rotate forward about the pivot to draw the sides of the cut away of the rear portion of the shell towards each other such that the sides of the shell will firmly grip the inner boot and the lower leg of the wearer to prevent raising of the heel of the wearer with respect to the heel portion of the shell.

5. A ski boot according to claim 4 having in addition a vertically adjustable slide means engaging the sides of the cut away of the rear portion of the shell whereby the amount of movement of the sides of the cut away of the rear portion towards each other when the leg is bent forward may be regulated.

6. A ski boot according to claim 4 having in addition a closure system for fastening said cuff with respect to said tongue including cable means adapted to be positioned in the valleys of the corrugations and variable thickness means for varying effective thickness of the cable means to variably limit movement of the hills of the corrugations towards each other when the leg of the wearer is bent in the forward direction.

7. A ski boot according to claim 1 wherein said stiff shell is divided into a front shell element and a rear shell element, wherein said corrugated front portion is integral with said front shell element and wherein said rear shell element is hinged at its bottom with respect to said front shell element whereby the rear shell element may be pivoted outwardly from the front shell element to allow insertion of the foot of the wearer into the boot.

8. A ski boot according to claim 7 wherein said rear shell element is corrugated to allow backward movement of the leg of the wearer with respect to the shell.

9. A ski boot according to claim 8 having in addition a closure system for fastening said rear shell element to said front shell element including cable means adapted to be positioned in the valleys of the corrugations and variable thickness means for varying the effective thickness of the cable means to variably limit movement of the hills of the corrugations towards each other when the leg of the wearer is bent.

* * * * *